US011773539B2

(12) United States Patent
Rouse et al.

(10) Patent No.: US 11,773,539 B2
(45) **Date of Patent: *Oct. 3, 2023**

(54) HIGH STRENGTH AND LOW STIFFNESS HESPERALOE TISSUE

(71) Applicant: Kimberly-Clark Worldwide, Inc., Neenah, WI (US)

(72) Inventors: Kayla Elizabeth Rouse, Appleton, WI (US); Richard Louis Underhill, Neenah, WI (US); David John Paulson, Appleton, WI (US); Felicia Marie Sauer, Greenville, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/085,828

(22) Filed: Dec. 21, 2022

(65) Prior Publication Data

US 2023/0122650 A1 Apr. 20, 2023

Related U.S. Application Data

(63) Continuation of application No. 17/168,857, filed on Feb. 5, 2021, now Pat. No. 11,566,379, which is a continuation of application No. 16/699,926, filed on Dec. 2, 2019, now Pat. No. 10,947,673, which is a continuation of application No. 16/412,828, filed on May 15, 2019, now Pat. No. 10,526,752, which is a continuation of application No. 15/816,422, filed on Nov. 17, 2017, now Pat. No. 10,337,149.

(60) Provisional application No. 62/425,670, filed on Nov. 23, 2016.

(51) Int. Cl.

| | |
|---|---|
| ***D21H 27/00*** | (2006.01) |
| ***D21H 11/12*** | (2006.01) |
| ***D21G 1/00*** | (2006.01) |
| ***D21H 27/42*** | (2006.01) |
| ***D21H 27/38*** | (2006.01) |
| ***D21F 11/04*** | (2006.01) |
| ***D21F 11/14*** | (2006.01) |

(52) U.S. Cl.

CPC ..... *D21H 27/005* (2013.01); *D21F 11/04* (2013.01); *D21F 11/14* (2013.01); *D21G 1/00* (2013.01); *D21H 11/12* (2013.01); *D21H 27/002* (2013.01); *D21H 27/38* (2013.01); *D21H 27/42* (2013.01)

(58) Field of Classification Search

CPC .... D21H 27/005; D21H 11/12; D21H 27/002; D21H 27/38; D21H 27/42; D21H 27/30; D21H 25/005; D21F 11/04; D21F 11/14; D21G 1/00

See application file for complete search history.

(56) References Cited

U.S. PATENT DOCUMENTS

| | | | | |
|---|---|---|---|---|
| 5,320,710 | A * | 6/1994 | Reeves | D21H 11/12 162/99 |
| 6,258,207 | B1 | 7/2001 | Pan | |
| 6,302,997 | B1 | 10/2001 | Hurter et al. | |
| 6,455,129 | B1 | 9/2002 | Kershaw et al. | |
| 6,511,579 | B1 | 1/2003 | Edwards et al. | |
| 7,682,488 | B2 | 3/2010 | Yeh et al. | |
| 8,049,060 | B2 | 11/2011 | Vinson et al. | |
| 8,741,104 | B2 | 6/2014 | Edwards et al. | |
| 10,132,036 | B2 | 11/2018 | Collins et al. | |
| 10,145,066 | B2 * | 12/2018 | Shannon | A47K 7/00 |
| 10,145,069 | B2 * | 12/2018 | Shannon | D21H 27/002 |
| 10,337,147 | B2 | 7/2019 | Rouse et al. | |
| 10,337,148 | B2 | 7/2019 | Rouse et al. | |
| 10,337,149 | B2 * | 7/2019 | Rouse | D21H 27/002 |
| 10,914,039 | B2 * | 2/2021 | Shannon | D21H 11/08 |
| 10,947,673 | B2 * | 3/2021 | Rouse | D21H 27/38 |
| 2002/0148584 | A1 | 10/2002 | Edwards et al. | |
| 2003/0192662 | A1 | 10/2003 | Heath et al. | |

(Continued)

FOREIGN PATENT DOCUMENTS

| | | | | |
|---|---|---|---|---|
| EP | 2513372 B1 | | 3/2014 | |
| EP | 3302200 B1 | * | 10/2020 | A47K 10/16 |

(Continued)

OTHER PUBLICATIONS

Eugenio et al., in "Evaluation of Hesperaloe funifera pulps obtained by a low energy consumption process as a reinforcement material in recycled pulps," Forest Systems 21(3) pp. 460-467. (Year: 2012).

Hurter, Robert W., in "Nonwood Plant Fiber Characteristics" HurterConsult pp. 1-4 (Year: 2001).

McLaughlin, Steven in "Properties of Paper Made From Fibers of Hesperaloe Funifera (Agavaceae)," Economic Botany, 54(2) pp. 192-196. (Year: 2000).

Deniz et al. in "Kraft and Modified Kraft Pulping of Bamboo (*Phyllostachys bambusoides*)," Drewno, 2017, vol. 60, No. 200.

(Continued)

*Primary Examiner* — Jose A Fortuna

(74) *Attorney, Agent, or Firm* — Kimberly-Clark Worldwide, Inc.

(57) ABSTRACT

Soft, durable and bulky tissue products comprising non-wood fibers and more particularly high yield hesperaloe pulp fibers are disclosed. The tissue products preferably comprise at least about 5 percent, by weight of the product, high yield hesperaloe pulp fiber and have relatively modest tensile strengths, such as a geometric mean tensile (GMT) greater than about 1,000 g/3", and improved durability and cross-machine direction (CD) properties, such as a CD Stretch greater than about 10 percent. Additionally, at the foregoing tensile strengths the products are not overly stiff. For example the tissue products may have a Stiffness Index less than about 10.0.

13 Claims, 1 Drawing Sheet

(56) References Cited

U.S. PATENT DOCUMENTS

| | | | | |
|---|---|---|---|---|
| 2004/0140076 | A1 | 7/2004 | Hermans et al. | |
| 2004/0168780 | A1 | 9/2004 | Dwiggins et al. | |
| 2004/0226673 | A1 | 11/2004 | Edwards et al. | |
| 2005/0236122 | A1 | 10/2005 | Mullally et al. | |
| 2007/0051484 | A1 | 3/2007 | Hermans et al. | |
| 2007/0107863 | A1 | 5/2007 | Edwards et al. | |
| 2008/0008853 | A1 | 1/2008 | Hupp et al. | |
| 2010/0126685 | A1 | 5/2010 | Fike et al. | |
| 2013/0068867 | A1 | 3/2013 | Hermans et al. | |
| 2013/0068868 | A1 | 3/2013 | Hermans et al. | |
| 2013/0071678 | A1 | 3/2013 | Shannon | |
| 2013/0199741 | A1 | 8/2013 | Stage et al. | |
| 2013/0269892 | A1 | 10/2013 | Hermans et al. | |
| 2014/0093704 | A1 | 4/2014 | Shi et al. | |
| 2014/0093705 | A1 | 4/2014 | Shi et al. | |
| 2014/0205777 | A1 | 7/2014 | Hawkins et al. | |
| 2014/0284010 | A1 | 9/2014 | Shannon | |
| 2015/0129143 | A1 | 5/2015 | Hawkins et al. | |
| 2018/0044859 | A1 | 2/2018 | Hermans et al. | |
| 2018/0135248 | A1* | 5/2018 | Collins | D21F 11/14 |
| 2018/0135249 | A1* | 5/2018 | Shannon | A47K 7/00 |
| 2018/0135253 | A1* | 5/2018 | Shannon | D21H 11/02 |
| 2018/0142419 | A1* | 5/2018 | Rouse | D21H 27/42 |
| 2018/0142420 | A1* | 5/2018 | Rouse | D21H 11/12 |
| 2018/0142421 | A1* | 5/2018 | Rouse | D21H 27/002 |
| 2019/0100878 | A1 | 4/2019 | Shannon et al. | |
| 2019/0100883 | A1* | 4/2019 | Shannon | D21H 27/002 |
| 2019/0264395 | A1* | 8/2019 | Rouse | D21H 11/12 |
| 2020/0102705 | A1* | 4/2020 | Rouse | D21G 1/00 |
| 2020/0115853 | A1* | 4/2020 | Shannon | D21H 27/30 |
| 2021/0156093 | A1* | 5/2021 | Rouse | D21H 11/12 |
| 2023/0122650 | A1* | 4/2023 | Rouse | D21H 11/12 162/129 |

FOREIGN PATENT DOCUMENTS

| | | | | |
|---|---|---|---|---|
| EP | 3302201 | B1 * | 10/2020 | A47K 10/16 |
| GB | 1374198 | A | 11/1974 | |
| MX | 2010001159 | A | 7/2011 | |
| WO | 2016195625 | A1 | 12/2016 | |
| WO | 2016195627 | A1 | 12/2016 | |
| WO | 2016195629 | A1 | 12/2016 | |

OTHER PUBLICATIONS

Protasio et al. in "Brazilian Lignocellulosic Wastes for Bioenergy Production: Characterization and Comparison with Fossil Fuels," BioResources 8(1), 1166-1185 (Year: 2013).

* cited by examiner

HIGH STRENGTH AND LOW STIFFNESS HESPERALOE TISSUE

RELATED APPLICATIONS

The present application is a continuation application and claims priority to U.S. patent application Ser. No. 17/168,857, filed on Nov. 5, 2021, which is a continuation application and claims priority to U.S. patent application Ser. No. 16/699,926, filed on Dec. 2, 2019, now U.S. Pat. No. 10,947,673, which is a continuation and claims priority to U.S. patent application Ser. No. 16/412,828, filed on May 15, 2019, now U.S. Pat. No. 10,526,752, which is a continuation application and claims priority to U.S. patent application Ser. No. 15/816,422, filed on Nov. 17, 2017, now U.S. Pat. No. 10,337,149, which claims benefit of U.S. Provisional Application No. 62/425,670 filed on Nov. 23, 2016, all of which are incorporated herein by reference in a manner consistent with the instant application.

BACKGROUND OF THE DISCLOSURE

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on the coarseness of pulp fibers. Pulps having fibers with low coarseness are desirable because tissue paper made from fibers having a low coarseness can be made softer than similar tissue paper made from fibers having a high coarseness. To optimize surface softness even further, premium tissue products usually comprise layered structures where the low coarseness fibers are directed to the outside layer of the tissue sheet with the inner layer of the sheet comprising longer, coarser fibers.

Unfortunately, the need for softness is balanced by the need for durability. Durability in tissue products can be defined in terms of tensile strength, tensile energy absorption (TEA), burst strength and tear strength. Typically tear, burst and TEA will show a positive correlation with tensile strength while tensile strength, and thus durability, and softness are inversely related. Thus the paper maker is continuously challenged with the need to balance the need for softness with a need for durability. Unfortunately, tissue paper durability generally decreases as the fiber length is reduced. Therefore, simply reducing the pulp fiber length can result in an undesirable trade-off between product surface softness and product durability.

Besides durability long fibers also play an important role in overall tissue product softness. While surface softness in tissue products is an important attribute, a second element in the overall softness of a tissue sheet is stiffness. Stiffness can be measured from the tensile slope of stress—strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by Northern softwood kraft (NSWK) fibers typically supply the best combination of durability and softness in tissue products when those fibers are used in combination with hardwood kraft fibers such as *Eucalyptus* hardwood kraft (EHWK) fibers. While NSWK fibers have a higher coarseness than EHWK fibers their small cell wall thickness relative to lumen diameter combined with their long length makes them the ideal candidate for optimizing durability and softness in tissue.

Unfortunately supply of NSWK is under significant pressure both economically and environmentally. As such, prices of NSWK have escalated significantly creating a need to find alternatives to optimize softness and strength in tissue products. Alternatives, however, are limited. For example, Southern softwood kraft (SSWK) may only be used in limited amounts in the manufacture of tissue products because its high coarseness results in stiffer, harsher feeling products than NSWK. Thus, there remains a need for an alternative to NSWK for the manufacture of premium tissue products, which must be both soft and strong.

SUMMARY OF THE DISCLOSURE

The present inventors have successfully used hesperaloe fibers to produce a tissue having satisfactory softness, strength and bulk. To produce the instant tissue products the inventors have successfully moderated the changes in strength and stiffness typically associated with substituting conventional wood papermaking fibers, such as NSWK, with hesperaloe fibers. Not only have the inventors succeeded in moderating changes to strength and stiffness they have done so without negatively effecting bulk. As such, the tissue products of the present invention have properties comparable to, or better than, those produced using conventional wood papermaking fibers. Accordingly, in certain embodiments, the invention provides tissue products comprising at least 5 percent, by weight of the tissue product, hesperaloe fibers, which in certain instances may replace at least about 50 percent of the NSWK, more preferably at least about 75 percent and still more preferably all NSWK without negatively effecting the tissue products strength, stiffness and bulk.

In other embodiments the present invention provides a tissue product comprising from about 5 to about 50 weight percent hesperaloe fiber, the tissue product having good durability, such as a Durability Index greater than about 30 and more preferably greater than about 35 and still more preferably greater than about 38 and improved cross-machine direction (CD) properties, such as a CD Stretch greater than about 10 percent, and more preferably greater than about 12 percent and a geometric mean tensile (GMT) greater than about 1,000 g/3". In certain preferred embodiments the foregoing tissue product may be substantially free from long average fiber length kraft fibers, such as NSWK and SSWK.

In still other embodiments the present invention provides a tissue product comprising at least about 5 weight percent hesperaloe fiber, the tissue product having a GMT greater than about 1,000 g/3", a CD tensile greater than about 500 g/3" and a CD TEA greater than about 5.0 g·cm/cm$^2$.

In yet other embodiments the present invention provides a tissue product comprising at least about 5 weight percent hesperaloe fiber, the tissue product having a GMT greater than about 1,000 g/3", a dry burst strength greater than about 800 gf and a GM Tear greater than about 15.0 gf. The foregoing tissue products not only have good durability, such as dry burst and GM Tear, but also have low stiffness, such as a Stiffness Index less than about 10.0 and more preferably less than about 8.0 and still more preferably less than about 7.0, such as from about 4.0 to about 10.0 and more preferably from about 4.0 to about 8.0 and still more preferably from about 4.0 to about 7.0.

In another embodiment the present invention provides a tissue product comprising at least one through-air dried tissue web, the web comprising at least about 5 weight percent hesperaloe fiber, the tissue product having a GMT greater than about 1,000 g/3", a CD tensile greater than about 500 g/3" and a Dry Burst greater than about 700 grams and more preferably greater than about 800 grams and still more preferably greater than about 900 grams.

In other embodiments the present invention provides a tissue product comprising from about 5 to about 50 weight percent hesperaloe fiber and substantially free from NSWK, the tissue product having a basis weight from about 20 to about 60 grams per square meter (gsm), a GMT greater than about 1,000 g/3", a CD tensile greater than about 500 g/3", a CD Stretch greater than about 10 percent and a CD TEA greater than about 5.0 g·cm/cm$^2$.

In still other embodiments the present invention provides a product comprising at least one multi-layered through-air dried tissue web comprising a first and a second layer, the first layer being substantially free from high yield hesperaloe pulp fibers and the second layer consisting essentially of high yield hesperaloe pulp fibers, the tissue product having a GMT greater than about 1,000 g/3" and a CD Stretch greater than about 10 percent, wherein the tissue product comprises from about 5 to about 50 weight percent high yield hesperaloe pulp fibers.

DEFINITIONS

Figure 1:
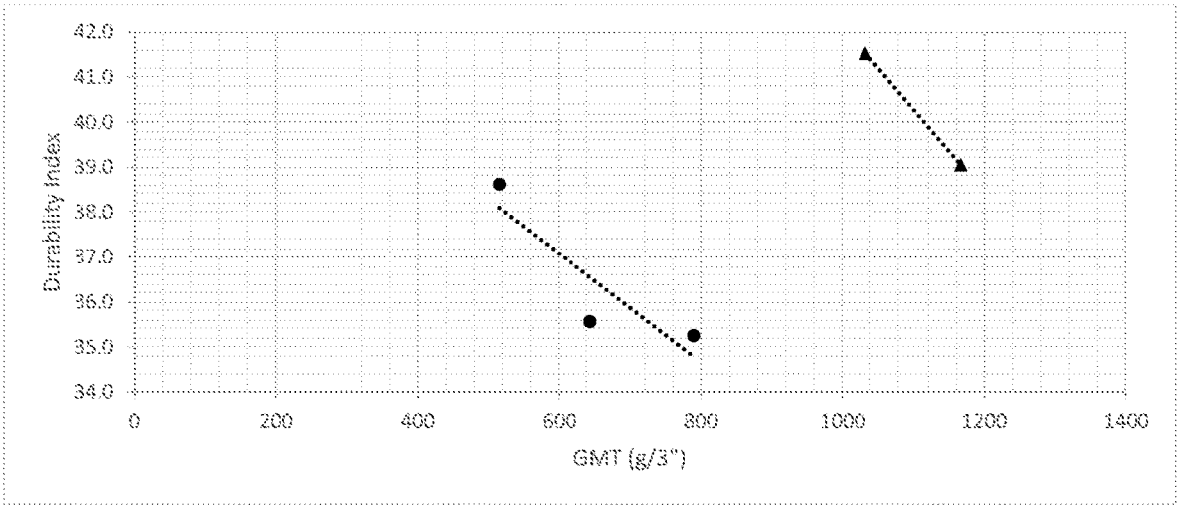
FIG. 1 is a graph illustrating the relationship between geometric mean tensile (GMT) and Durability Index for a control tissue product (●) and a tissue product comprising 40 percent, by weight, high yield hesperaloe fiber (▲)
Figure 2:
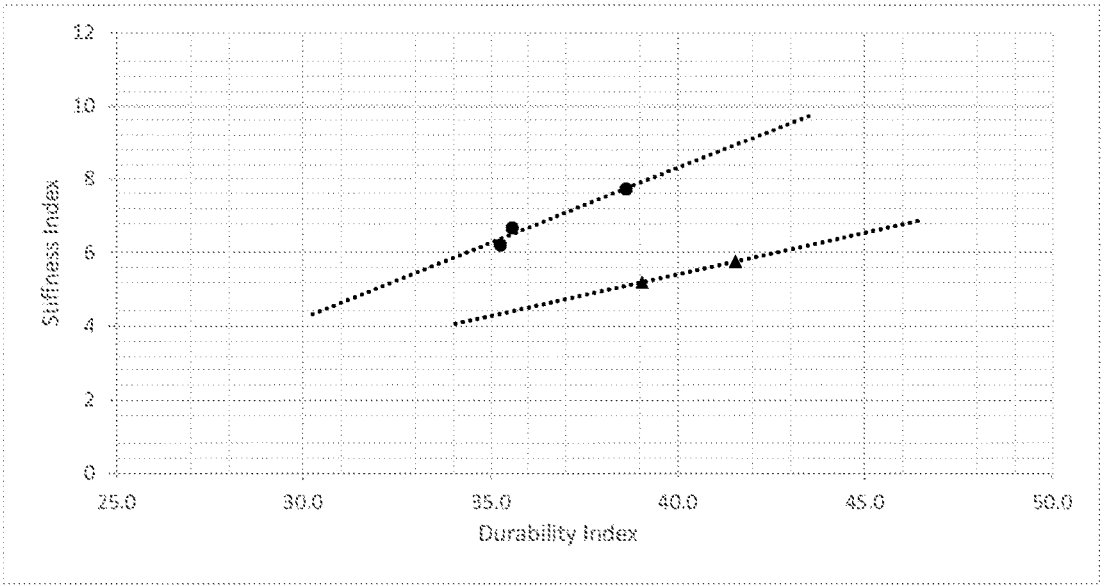
FIG. 2 is a graph illustrating the relationship between Durability Index and Stiffness Index for a control tissue product (●) and a tissue product comprising 40 percent, by weight, high yield hesperaloe fiber (▲).

As used herein, a "Tissue Product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein, the term "Layer" refers to a plurality of strata of fibers, chemical treatments, or the like, within a ply.

As used herein, the terms "Layered Tissue Web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Basis Weight" generally refers to the bone dry weight per unit area of a tissue and is generally expressed as grams per square meter (gsm). Basis weight is measured using TAPPI test method T-220.

As used herein, the term "Burst Index" refers to the dry burst peak load (typically having units of grams) at a relative geometric mean tensile strength (typically having units of grams per three inches) as defined by the equation:

$$\text{Burst Index} = \frac{\text{Dry Burst Peak Load (g)}}{GMT\,(\text{g}/3'')} \times 10$$

While Burst Index may vary, tissue products prepared according to the present disclosure may, in certain embodiments, have a Burst Index greater than about 8.0, more preferably greater than about 9.0 and still more preferably greater than about 10.0, such as from about 8.0 to about 12.0 and more preferably from about 9.0 to about 12.0.

As used herein, the term "TEA Index" refers to the geometric mean tensile energy absorption (typically expressed in g·cm/cm$^2$) at a given geometric mean tensile strength (typically having units of grams per three inches) as defined by the equation:

$$TEA\ \text{Index} = \frac{GM\ TEA\ (\text{g}\cdot\text{cm/cm2})}{GMT\,(\text{g}/3'')} \times 1,000$$

While the TEA Index may vary, tissue products prepared according to the present disclosure may, in certain embodiments, have a TEA Index greater than about 10.0, more preferably greater than about 11.0 and still more preferably greater than about 12.0, such as from about 10.0 to about 14.0.

As used herein, the term "Tear Index" refers to the GM Tear Strength (typically expressed in grams) at a relative geometric mean tensile strength (typically having units of grams per three inches) as defined by the equation:

$$\text{Tear Index} = \frac{GM\ \text{Tear (g)}}{GMT\ (\text{g}/3'')} \times 1,000$$

While the Tear Index may vary, tissue products prepared according to the present disclosure may, in certain embodiments, have a Tear Index greater than about 17.0, more preferably greater than about 18.0 and still more preferably greater than about 19.0.

As used herein, the term "Durability Index" refers to the sum of the Tear Index, the Burst Index, and the TEA Index and is an indication of the durability of the product at a given tensile strength.

Durability Index=Tear Index+Burst Index+TEA Index

While the Durability Index may vary, tissue products prepared according to the present disclosure may, in certain embodiments, have a Durability Index value greater than about 38, more preferably greater than about 39 and still more preferably greater than about 40.

As used herein, the term "Caliper" is the representative thickness of a single sheet (caliper of tissue products comprising one or more plies is the thickness of a single sheet of tissue product comprising all plies) measured in accordance with TAPPI test method 1402 using a ProGage 500 Thickness Tester (Thwing-Albert Instrument Company, West Berlin, NJ). The micrometer has an anvil diameter of 2.22 inches (56.4 mm) and an anvil pressure of 132 grams per square inch (per 6.45 square centimeters) (2.0 kPa). As used herein, the term "Sheet Bulk" refers to the quotient of the caliper (μm) divided by the bone dry basis weight (gsm). The resulting sheet bulk is expressed in cubic centimeters per gram (cc/g). Tissue products prepared according to the present invention may, in certain embodiments, have a sheet bulk greater than about 10 cc/g, more preferably greater than about 11 cc/g and still more preferably greater than about 12 cc/g.

As used herein, the term "Fiber Length" refers to the length weighted average length (LWAFL) of fibers determined utilizing an OpTest Fiber Quality Analyzer-360 (OpTest Equipment, Inc., Hawkesbury, ON). The length weighted average length is determined in accordance with the manufacturer's instructions and generally involves first accurately weighing a pulp sample (10-20 mg for hardwood, 25-50 mg for softwood) taken from a one-gram handsheet made from the pulp. The moisture content of the handsheet should be accurately known so that the actual amount of fiber in the sample is known. This weighed sample is then diluted to a known consistency (between about 2 and about 10 mg/l) and a known volume (usually 200 ml) of the diluted pulp is sampled. This 200 ml sample is further diluted to 600 ml and placed in the analyzer. The length-weighted average fiber length is defined as the sum of the product of the number of fibers measured and the length of each fiber squared divided by the sum of the product of the number of fibers measured and the length of the fiber. Fiber lengths are generally reported in millimeters.

As used herein, the term "Coarseness" generally refers to the weight per unit length of fiber, commonly having units of mg/100 meters. Coarseness is measured according to ISO Coarseness Testing Method 23713 utilizing an OpTest Fiber Quality Analyzer-360 (OpTest Equipment, Inc., Hawkesbury, ON).

As used herein, the term "Hesperaloe Fiber" refers to a fiber derived from a plant of the genus Hesperaloe of the family Asparagaceae including, for example, *H. funifera, H. parviflora, H. nocturne, H. chiangii, H. tenuifolia, H. engelmannii*, and *H. malacophylla*. The fibers are generally processed into a pulp for use in the manufacture of tissue products according to the present invention. Preferably the pulping process is a high yield pulping process, such as a pulping process having a yield greater than about 60 percent, such as from about 60 to about 90 percent and more preferably from about 65 to about 90 percent. The foregoing yields generally refer to the yield of unbleached hesperaloe fiber.

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "Geometric Mean Slope" (GM Slope) generally refers to the square root of the product of machine direction slope and cross-machine direction slope.

As used herein, the terms "Geometric Mean Tensile" (GMT) refer to the square root of the product of the machine direction tensile strength and the cross-machine direction tensile strength of the web. While the GMT may vary, tissue products prepared according to the present disclosure may, in certain embodiments, have a GMT greater than about 1,000 g/3".

As used herein, the term "Stiffness Index" refers to the quotient of the geometric mean tensile slope, defined as the square root of the product of the machine direction (MD) and cross-machine direction (CD) slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope (kg)}}}{GMT\ (\text{g}/3'')} \times 1,000$$

While the Stiffness Index may vary, tissue products prepared according to the present disclosure may, in certain embodiments, have a Stiffness Index less than about 10.0 and more preferably less than about 8.0 and still more preferably less than about 7.0, such as from about 4.0 to about 10.0 and more preferably from about 4.0 to about 8.0 and still more preferably from about 4.0 to about 7.0.

As used herein, the term "Slough," also referred to herein as "pilling" and "Scott pilling," refers to the undesirable sloughing off of bits of the tissue web when rubbed and is generally measured as described in the Test Methods section below. Slough is generally reported in terms of mass, such as milligrams. While slough may vary, tissue products prepared according to the present disclosure may, in certain embodiments, have a slough less than about 8.0 mg, more preferably less than about 6.0 mg and still more preferably less than about 5.0 mg.

As used herein the term "Tensile Ratio" generally refers to the ratio of machine direction (MD) tensile (having units of g/3") and the cross-machine direction (CD) tensile (having units of g/3"). While the Tensile Ratio may vary, tissue products prepared according to the present disclosure may, in certain embodiments, have a Tensile Ratio less than about 2.5, such as from about 1.5 to about 2.5 and more preferably from about 1.75 to about 2.25.

DETAILED DESCRIPTION OF THE DISCLOSURE

Generally the skilled tissue maker is concerned with balancing various tissue properties such as bulk, softness, stiffness and strength. For example, the tissue maker often desires to increase bulk without stiffening the tissue product or reducing softness, while at the same time maintaining a given tensile strength. Previous attempts to manufacture tissue using hesperaloe fibers have not successfully balanced these important tissue properties resulting in reduced bulk with dramatic increases in tensile and stiffness. Despite the failings of the prior art, the present inventors have now succeeded in moderating the changes in strength and stiffness without negatively effecting bulk when manufacturing a tissue product comprising hesperaloe fibers, as illustrated in Table 1, below.

TABLE 1

| Example | Furnish | Delta Bulk | Delta GMT | Delta GM Slope |
|---|---|---|---|---|
| US 5,320,710 | 50% *H. Funifera* 50% NSWK | −20% | 192% | 65% |
| Inventive | 40% *H. Funifera* 60% EHWK | 20% | 31% | 20% |

Not only were previous attempts to balance bulk, strength, stiffness and softness unsuccessful, the resulting tissue products were not suitable for use as premium bath tissue because the strengths and modulus were excessively high. For example, when compared to Northern® Bathroom Tissue the inventive code of U.S. Pat. No. 5,320,710 had 11 percent lower bulk, 23 percent greater modulus and 148 percent greater stiffness (measured as the modulus divided by the tensile strength). The present inventors have overcome these failings to provide a tissue product that is comparable or better than commercially available bath tissue products. For example, the tissue products of the present invention have comparable or better physical properties than currently available commercial products, as illustrated in Table 2, below.

TABLE 2

| Product | Plies | Sheet Bulk (cc/g) | GMT (g/3") | CD Stretch (%) | CD TEA (g · cm/cm$^2$) | GM Tear (gf) | Slough (mg) |
|---|---|---|---|---|---|---|---|
| Charmin ® Basic | 1 | 10.8 | 1028 | 8.8 | 7.6 | 18.5 | 5.0 |
| Charmin ® Ultra Strong | 2 | 13.3 | 1149 | 10.5 | 9.4 | 24.1 | 6.1 |
| Northern ® Ultra Soft & Strong | 2 | 11.6 | 826 | 8.2 | 6.4 | 18.2 | 10.2 |
| Cottonelle ® Clean Care | 1 | 11.6 | 787 | 8.7 | 4.9 | 14.4 | 8.6 |
| Cottonelle ® Comfort Care | 2 | 12.6 | 909 | 11.2 | 7.3 | 22.1 | 8.6 |
| Inventive | 1 | 16.7 | 1032 | 11.9 | 6.9 | 19.7 | 5.9 |

Without being bound by any particular theory, the high degree of strength and stiffness observed previously in tissue products may be attributed in-part to the morphology of hesperaloe fiber when prepared by chemical pulping, which has a relatively long fiber length, high aspect ratio and high ratio of fiber length to cell wall thickness. A comparison of the morphology of hesperaloe kraft pulp fibers and conventional papermaking pulp fibers, as reported previously in U.S. Pat. No. 5,320,710, is provided in Table 3, below.

TABLE 3

| Fiber | Fiber Length (mm) | Coarseness (mg/100 m) |
|---|---|---|
| H. *Funifera* kraft pulp | 2.96 | 8.0 |
| NSWK | 2.92 | 14.2 |
| SSWK | 3.46 | 26.7 |
| EHWK | 0.99 | 7.6 |

The present inventors have now discovered that hesperaloe fibers processed by high yield pulping means, such as mechanical pulping, may overcome the limitations of kraft hesperaloe pulp fibers. Moreover, high yield hesperaloe fibers may be a suitable replacement for softwood kraft fibers without decreasing bulk, significantly altering tensile, increasing stiffness or reducing softness. As such, the tissue webs and products of the present invention generally comprise at least about 5 percent, by weight of the web or product, and more preferably at least about 10 percent and still more preferably at least about 15 percent, such as from about 5 to about 50 percent, and more preferably from about 20 to about 50 percent, such as from about 20 to about 40 percent, high yield hesperaloe fiber.

High yield pulping processes useful for the manufacture of high yield hesperaloe pulps include, for example, mechanical pulp (MP), refiner mechanical pulp (RMP), pressurized refiner mechanical pulp (PRMP), thermomechanical pulp (TMP), high temperature TMP (HT-TMP), RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Preferably the high yield pulping process has a yield greater than about 60 percent, such as from about 60 to about 90 percent and more preferably from about 65 to about 90 percent. The foregoing yields generally refer to the yield of unbleached hesperaloe fiber The high yield pulping process may comprise heating the hesperaloe fiber above ambient, such as from about 70 to about 200° C., and more preferably from about 90 to about 150° C. while subjecting the fiber to mechanical forces. Caustic or an oxidizing agent may be introduced to the process to facilitate fiber separation by the mechanical forces. For example, in one embodiment, a solution of 3 to about 8 percent NaOH and a solution of 3 to about 8 percent peroxide may be added to the fiber during mechanical treatment to facilitate fiber separation.

In other embodiments the high yield pulping process may comprise treating hesperaloe leaves with an alkaline pulping solution such as that disclosed in U.S. Pat. No. 6,302,997, the contents of which are incorporated herein in a manner consistent with the present disclosure. Alkaline treatment may be carried out at a pressure from about atmospheric pressure to about 30 psig and at a temperature ranging from about ambient temperature to about 150° C. The alkaline hydroxide may be added, based upon the oven dried mass of the hesperaloe leaves, from about 10 to about 30 percent. Suitable alkaline pulping solutions include, for example, sodium hydroxide, potassium hydroxide, ammonium hydroxide, calcium hydroxide, and combinations thereof. After alkaline treatment, the hesperaloe is mechanically worked and then treated with an acid solution to reduce the pH to an acid pH.

In other embodiments the high yield pulping process may comprise impregnating hesperaloe leaves with a solution of nitric acid and optionally ammonium hydroxide at ambient temperatures under atmospheric pressure, such as described in U.S. Pat. No. 7,396,434, the contents of which are incorporated herein in a manner consistent with the present invention. The impregnated leaves are then heated to evaporate the nitric acid followed by treatment with an alkaline solution before being cooled.

Although a caustic, such as NaOH, or oxidizing agent, such as nitric acid or peroxide, may be added during processing, it is generally preferred that the hesperaloe fiber is not pretreated with a sodium sulfite or the like prior to processing. For example, high yield hesperaloe pulps are generally prepared without pretreatment of the fiber with an aqueous solution of sodium sulfite, or the like, which is commonly employed in the manufacture of chemi-mechanical wood pulps.

High yield hesperaloe pulp may be used to manufacture tissue products according to the present invention by any number of different methods known in the art. In one example, the method comprises the steps of (a) forming an embryonic fibrous web comprising high yield hesperaloe pulp, (b) molding the embryonic web using a molding member, such as a three-dimensional papermaking belt and (c) drying the web. The embryonic web can be formed and dried in a wet-laid process using a conventional process, conventional wet-press, through-air drying process, fabric-creping process, belt-creping process or the like. When forming multi-ply tissue products, the separate plies can be made from the same process or from different processes as desired.

In particularly preferred embodiments tissue webs comprising hesperaloe fibers are formed by through-air drying and can be either creped or uncreped. For example, the present invention may utilize the papermaking process disclosed in U.S. Pat. Nos. 5,656,132 and 6,017,417, which are incorporated herein in a manner consistent with the present disclosure. The embryonic fibrous web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, NY) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, WI).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross-machine (CD) or machine direction (MD) (expressed as percent elongation at sample failure). For example, the relative speed difference between the two fabrics can be from about 1 to about 45 percent, in some embodiments from about 5 to about 30 percent, and in some embodiments, from about 15 to about 28 percent. This is commonly referred to as "rush transfer". During "rush transfer", many of the bonds of the web are believed to be broken, thereby forcing the sheet to bend and fold into the depressions on the surface of the transfer fabric. Such molding to the contours of the surface of the transfer fabric may increase the MD and CD stretch of the web.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting.

In other embodiments the embryonic fibrous structure is formed by a wet-laid forming section and transferred to a through-air drying fabric with the aid of vacuum air. The embryonic fibrous structure is molded to the through-air drying fabric and partially dried to a consistency of about 40 to about 70 percent with a through-air dried process. The partially dried web is then transferred to the surface of a cylindrical dryer, such as a Yankee dryer, by a pressure roll. The web is pressed and adhered onto the Yankee dryer surface having a coating of creping adhesive. The fibrous structure is dried on the Yankee surface to a moisture level of about 1 to about 5 percent moisture where it is separated from the Yankee surface with a creping process. The creping blade bevel can be from 15 to about 45 percent with the final impact angle from about 70 to about 105 degrees.

Tissue webs, prepared as described above, may be incorporated into tissue products comprising a single ply or multiple plies, such as two, three or four plies. The products may be subjected to further processing including, but not limited to, printing, embossing, calendering, slitting, folding, combining with other fibrous structures, and the like.

The tissue products generally have a basis weight greater than about 10 grams per square meter (gsm), for example from about 10 to about 60 gsm and more specifically from about 15 to about 45 gsm. In certain embodiments the present disclosure provides a single-ply through-air dried tissue product having a basis weight from about 30 to about 60 gsm. At the foregoing basis weights tissue products prepared according to the present disclosure have geometric mean tensile (GMT) greater than about 1,000 g/3", such as from about 1,000 to about 1,500 g/3" and more specifically from about 1,000 to about 1,200 g/3".

Regardless of how the webs are converted to tissue products, the products of the present invention generally comprise at least about 5 percent, and more preferably at least about 10 percent, and still more preferably at least about 20 percent, by weight of the product, high yield hesperaloe fiber. In certain preferred embodiments hesperaloe fiber may replace all or a portion of the long fiber fraction of the papermaking furnish, such as NSWK or SSWK. Accordingly, in certain embodiments, hesperaloe fibers may replace at least about 50 percent of the NSWK or SSWK in the tissue product, more preferably at least about 75 percent and still more preferably all NSWK or SSWK. In certain embodiments replacement of all or a portion of the long fiber fraction of the papermaking furnish with hesperaloe fiber may be accomplished without negatively effecting the tissue product's softness and durability.

In still other embodiments single- or multi-ply tissue products may be formed from one or more multi-layered plies having hesperaloe fibers selectively incorporated in one of its layers. For example, the tissue product may comprise two multi-layered through-air dried webs wherein each web comprises a first fibrous layer substantially free from hesperaloe fibers and a second fibrous layer comprising hesperaloe fibers. The webs are plied together such that the outer surface of the tissue product is formed from the first fibrous layer of each web and the second fibrous layer comprising the hesperaloe fibers is not brought into contact with the user's skin in-use.

The ability to substitute the long fiber fraction of the papermaking furnish with hesperaloe fiber without negatively affecting important tissue properties is highlighted in Table 4, below. All tissues shown in Table 4 are single-ply products having a basis weight of about 35 grams per square meter (gsm) and comprising either 40 weight percent NSWK or hesperaloe and 60 weight percent EHWK, based upon the total weight of the tissue product. Surprisingly substituting NSWK with hesperaloe provides improved durability without stiffening or dramatically increasing tensile strength.

TABLE 4

| | NSWK | High Yield Hesperaloe Fiber | Delta |
|---|---|---|---|
| GMT (g/3") | 790 | 1032 | 31% |
| GM Tear (g) | 12.2 | 19.7 | 61% |
| Dry Burst (g) | 703 | 1051 | 50% |
| CD Stretch (%) | 10.1 | 11.9 | 18% |
| Durability Index | 35.3 | 41.5 | 18% |
| Stiffness Index | 6.21 | 5.76 | −7% |

Accordingly, in certain embodiments the present invention provides tissue products that are not only soft, but are strong enough to withstand use, having both good tensile strength and durability. As such the tissue products generally have a GMT greater than about 1,000 g/3", such as from about 1,000 to about 1,500 g/3", and more preferably from about 1,000 to about 1,200 g/3", and a Durability Index greater than about 35 and more preferably greater than about 38 and still more preferably greater than about 40.

In other embodiments the tissue products have a Stiffness Index less than about 10.0 and more preferably less than about 8.0, and still more preferably less than about 7.0, such as from about 4.0 to about 10.0 and more preferably from about 4.0 to about 7.0, and a Durability Index greater than about 35 and more preferably greater than about 38 and still more preferably greater than about 40. In one particularly preferred embodiment the tissue product comprises a through-air dried web comprising less than about 5 weight percent NSWK, and from about 10 to about 40 weight percent hesperaloe fiber, the tissue product having a Durability Index from about 35 to about 40 and a Stiffness Index from about 4.0 to about 8.0.

In addition to having improved durability and relatively modest tensile strength, the instant tissue products have favorable CD properties, such as a CD stretch greater than about 10.0 percent, such as from about 10.0 to about 14.0 percent. Generally, at the foregoing levels of CD stretch the tissue products also have relatively high CD tensile strength, such as greater than about 500 g/3", such as from about 500 to about 800 g/3". In a particularly preferred embodiment the tissue products have a CD stretch from about 10.0 to about 12.0 percent and a CD tensile from about 500 to about 800 g/3". At these levels of CD tensile strength and CD stretch the tissue products of the present disclosure are highly durable, particularly in what is generally the weakest orientation of the tissue product—the cross-machine direction. Accordingly, tissue products of the present disclosure generally withstand use better than prior art tissue products.

In still other embodiments the present invention provides a tissue product comprising at least about 5 percent, by weight of the tissue product, high yield hesperaloe, the product having a GMT greater than about 1,000 g/3", a CD tensile greater than about 500 g/3" and a CD Stretch greater than about 10 percent and more preferably greater than about 12 percent. In addition to having improved stretch, the foregoing tissue may also have improved CD TEA, such as a CD TEA greater than about 5.0 and more preferably greater than about 6.0 and still more preferable greater than about 7.0 g·cm/cm$^2$, such as from about 6.0 to about 8.0 g·cm/cm$^2$. In certain instances the foregoing tissue products may have a Tensile Ratio less than about 2.5, such as from about 1.5 to about 2.5 and more preferably from about 1.75 to about 2.25.

In yet other embodiments tissue prepared according to the present invention may have lower slough even at higher basis weights. Accordingly, the invention provides a tissue product comprising at least about 5 percent, by weight of the product, hesperaloe fiber, wherein the product has a basis weight of at least about 30 gsm, and more preferably at least about 35 gsm and a slough less than about 8.0 mg, more preferably less than about 6.0 mg and still more preferably less than about 5.0 mg. Further, tissue products having low slough generally also have good tensile strength, such as a GMT greater than about 1,000 g/3", such as from about 1,000 to about 1,200 g/3".

Not only do the instant tissue webs and products display improved durability and CD properties, they also have good compression resistance. For example, the tissue webs of the present invention are surprisingly resilient and retain a high degree of bulk compared to similar webs prepared without hesperaloe fiber. A comparison of various tissue webs illustrating this effect are shown in Table 5, below.

TABLE 5

| Sample | HYH Fiber (wt %) | Calender Load (pli) | Initial Sheet Bulk (cc/g) | Finished Sheet Bulk (cc/g) | Delta Sheet Bulk (%) |
|---|---|---|---|---|---|
| Conventional | — | 40 | 30.6 | 14.0 | −54% |
| Inventive | 40 | 40 | 30.1 | 16.7 | −45% |

The increased resiliency allows the webs to be calendered to produce a soft tissue product without a significant decrease in bulk.

TEST METHODS

Sheet Bulk

Sheet Bulk is calculated as the quotient of the dry sheet caliper (μm) divided by the bone dry basis weight (gsm).

Dry sheet caliper is the measurement of the thickness of a single sheet of tissue product (comprising all plies) measured in accordance with TAPPI test method T402 using a ProGage 500 Thickness Tester (Thwing-Albert Instrument Company, West Berlin, NJ). The micrometer has an anvil diameter of 2.22 inches (56.4 mm) and an anvil pressure of 132 grams per square inch (per 6.45 square centimeters) (2.0 kPa).

Slough

Slough, also referred to as "pilling," is a tendency of a tissue sheet to shed fibers or clumps of fibers when rubbed or otherwise handled. The slough test provides a quantitative measure of the abrasion resistance of a tissue sample. More specifically, the test measures the resistance of a material to an abrasive action when the material is subjected to a horizontally reciprocating surface abrader. The equipment and method used is similar to that described in U.S. Pat. No. 6,808,595, the disclosure of which is herein incorporated by reference to the extent that it is non-contradictory herewith.

FIG. 3 of U.S. Pat. No. 6,808,595 illustrates the test equipment used to measure pilling. Shown is the abrading spindle or mandrel, a double arrow showing the motion of the mandrel, a sliding clamp, a slough tray, a stationary clamp, a cycle speed control, a counter, and start/stop controls. The abrading spindle consists of a stainless steel rod, 0.5 inches in diameter with the abrasive portion consisting of a 0.005 inches deep diamond pattern knurl extending 4.25 inches in length around the entire circumference of the rod. The abrading spindle is mounted perpendicularly to the face of the instrument such that the abrasive portion of the abrading spindle extends out its entire distance from the face of the instrument. On each side of the abrading spindle is located a pair of clamps, one movable and one fixed, spaced 4 inches apart and centered about the abrading spindle. The movable clamp (weighing approximately 102.7 grams) is allowed to slide freely in the vertical direction, the weight of the movable clamp providing the means for insuring a constant is tension of the tissue sheet sample over the surface of the abrading spindle.

Prior to testing, all tissue sheet samples are conditioned at 23±1° C. and 50±2 percent relative humidity for a minimum of 4 hours. Using a JDC-3 or equivalent precision cutter, available from Thwing-Albert Instrument Company, Philadelphia, PA, the tissue sheet sample specimens are cut into 3±0.05 inches wide×7 inches long strips (note: length is not critical as long as specimen can span distance so as to be inserted into the clamps). For tissue sheet samples, the MD direction corresponds to the longer dimension. Each tissue sheet sample is weighed to the nearest 0.1 mg. One end of the tissue sheet sample is clamped to the fixed clamp, the sample then loosely draped over the abrading spindle or mandrel and clamped into the sliding clamp. The entire width of the tissue sheet sample should be in contact with the abrading spindle. The sliding clamp is then allowed to fall providing constant tension across the abrading spindle.

The abrading spindle is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws and any loose fibers on the surface of the tissue sheet sample are removed by gently shaking the tissue sheet sample. The tissue sheet sample is then weighed to the nearest 0.1 mg and the weight loss calculated. Ten tissue sheet specimens per sample are tested and the average weight loss value in milligrams (mg) is recorded, which is the Pilling value for the side of the tissue sheet being tested.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006 inches) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single-ply basesheet. This is done by multiplying the single-ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, MN) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings have an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises three sheets of product. For example, if the product is a 2-ply tissue product, three sheets of product, totaling six plies are tested. If the product is a single-ply tissue product, then three sheets of product totaling three plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

EXAMPLES

Basesheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Base sheets with a target bone dry basis weight of about 36 grams per square meter (gsm) were produced. The base sheets were then converted and spirally wound into rolled tissue products.

HYH pulp was produced by processing *H. Funifera* using a high yield pulping process commercially available from Phoenix Pulp and Polymer (Dayton, WA). The physical properties of the HYH pulp are summarized in Table 6, below. The HYH pulp was prepared by dispersing about 50 pounds (oven dry basis) HYH pulp in a pulper for 30 minutes at a consistency of about 3 percent. The fiber was then transferred to a machine chest and diluted to a consistency of 1 percent.

TABLE 6

| Fiber | Fiber Length (mm) | Average Fiber Width (μm) | Aspect Ratio | Coarseness (mg/100 m) |
|---|---|---|---|---|
| High Yield *H. Funifera* pulp | 2.5 | 19.9 | 125 | 7.3 |

In all cases the base sheets were produced from various fiber furnishes including, Eucalyptus hardwood kraft (EHWK) pulp, NSWK pulp, and high yield hesperaloe pulp (HYH) using a layered headbox fed by three stock chests. As such the resulting tissue webs had three layers (two outer layers and a middle layer). The two outer layers comprised EHWK (each layer comprising 30 percent weight by total weight of the web) and the middle layer comprised either NSWK or HYH. In certain instances the middle layer was refined to control the strength of the web. The composition of the webs is further described in Table 7, below.

TABLE 7

| Sample | Layer Furnish Split (outer layer/middle layer/outer layer (wt %)) | Redibond 2038 A (kg/ton)/Layer | ProSoft (kg/ton)/Layer | FennoBond 3000 (kg/ton)/Layer | Furnish Refined |
|---|---|---|---|---|---|
| Control 1 | EHWK (30)/NSWK (40)/EHWK (30) | 2/Middle | 4/Outer | 2.5/Middle | 0 |
| Control 2 | EHWK (30)/NSWK (40)/EHWK (30) | 2/Middle | 4/Outer | 2.5/Middle | Middle |
| Control 3 | EHWK (30)/NSWK (40)/EHWK (30) | 2/Middle | 4/Outer | 2.5/Middle | Middle |
| Inventive 11 | EHWK (30)/HYH (40)/EHWK (30) | — | 4/Outer | 2.5/Middle | Middle |
| Inventive 12 | EHWK (30)/HYH (40)/EHWK (30) | 4/Middle | 4/Outer | 2.5/Middle | Middle |

The formed web was non-compressively dewatered and rush transferred to a transfer fabric traveling at a speed about 28 percent slower than the forming fabric. The web was then transferred from the transfer fabric to a T-1205-2 throughdrying fabric (commercially available from Voith Fabrics, Appleton, WI, and previously disclosed in U.S. Pat. No. 8,500,955, the contents of which are incorporated herein in a manner consistent with the present disclosure) with the assistance of vacuum. The web was then dried and wound into a parent roll.

The base sheet webs were converted into bath tissue rolls. Specifically, the base sheet was calendered using a conventional polyurethane/steel calender system comprising a 40 P&J polyurethane roll on the air side of the sheet and a standard steel roll on the fabric side (calender load set forth in Table 8, below). The calendered web was then converted into a rolled product comprising a single-ply. The finished products were subjected to physical analysis, which is summarized below. The effect of hesperaloe fibers on various tissue properties, including tensile, durability and stiffness, is summarized in Tables 9-11, below.

TABLE 8

| Sample | Calendar Load (PLI) | Basesheet Caliper (μm) | Product Caliper (μm) | Delta Caliper (%) | Basesheet Sheet Bulk (cc/g) | Product Sheet Bulk (cc/g) | Delta Sheet Bulk (%) |
|---|---|---|---|---|---|---|---|
| Control 1 | 40 | 1059 | 468 | −56% | 29.4 | 13.3 | −54% |
| Control 2 | 40 | 1074 | 472 | −56% | 29.8 | 13.0 | −56% |
| Control 3 | 40 | 1100 | 507 | −54% | 30.6 | 14.0 | −54% |
| Inventive 11 | 40 | 1094 | 594 | −46% | 30.1 | 16.7 | −45% |
| Inventive 12 | 40 | 1087 | 580 | −47% | 29.8 | 16.2 | −46% |

TABLE 9

| Sample | Basis Weight (gsm) | GMT (g/3") | GM TEA ($g \cdot cm/cm^2$) | GM Slope (kg) | GM Tear (gf) | Dry Burst (gf) |
|---|---|---|---|---|---|---|
| Control 1 | 35.0 | 515 | 5.50 | 3.96 | 9.73 | 466 |
| Control 2 | 36.3 | 643 | 6.47 | 4.28 | 10.6 | 580 |
| Control 3 | 36.4 | 790 | 8.62 | 4.91 | 12.2 | 703 |
| Inventive 11 | 35.6 | 1032 | 12.65 | 5.91 | 19.7 | 1051 |
| Inventive 12 | 35.8 | 1167 | 14.12 | 6.07 | 20.1 | 1135 |

TABLE 10

| Sample | Tensile Ratio | CD Tensile (g/3") | CD Stretch (%) | CD TEA (g · cm/cm$^2$) |
|---|---|---|---|---|
| Control 1 | 2.25 | 343 | 9.8 | 3.444 |
| Control 2 | 2.29 | 425 | 9.7 | 3.767 |
| Control 3 | 2.33 | 517 | 10.1 | 4.981 |
| Inventive 11 | 2.54 | 647 | 11.9 | 6.860 |
| Inventive 12 | 2.13 | 799 | 12.6 | 7.989 |

TABLE 11

| Sample | TEA Index | Tear Index | Burst Index | Durability Index | Stiffness Index | Slough (mg) |
|---|---|---|---|---|---|---|
| Control 1 | 10.7 | 18.9 | 9.0 | 38.6 | 7.73 | 10.1 |
| Control 2 | 10.1 | 16.5 | 9.0 | 35.6 | 6.68 | 12.0 |
| Control 3 | 10.9 | 15.4 | 8.9 | 35.3 | 6.21 | 12.3 |
| Inventive 11 | 12.3 | 19.1 | 10.2 | 41.5 | 5.76 | 5.9 |
| Inventive 12 | 12.1 | 17.2 | 9.7 | 39.0 | 5.20 | 4.8 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product comprising at least about 5 percent high yield hesperaloe fiber, by weight of the tissue product, the tissue product having a geometric mean tensile (GMT) greater than about 1,000 g/3", a CD stretch greater than about 10 percent and a Durability Index greater than about 38.0.

In a second embodiment the present invention provides the tissue product of the first embodiment having a dry burst strength greater than about 800 gf.

In a third embodiment the present invention provides the tissue product of the first or the second embodiments having a GM TEA greater than about 9.0 g·cm/cm$^2$.

In a fourth embodiment the present invention provides the tissue product of any one of the first through the third embodiments having a CD TEA greater than about 5.0 g·cm/cm$^2$.

In a fifth embodiment the present invention provides the tissue product of any one of the first through the fourth embodiments wherein the GM Slope is less than about 6.0 kg.

In a sixth embodiment the present invention provides the tissue product of any one of the first through the fifth embodiments having a GMT from about 1,000 to about 1,200 g/3" and a Stiffness Index less than about 10.0.

In a seventh embodiment the present invention provides the tissue product of any one of the first through the sixth embodiments wherein the tissue product has a slough less than about 8.0 mg and more preferably less than about 7.0 mg and still more preferably less than about 6.0 mg.

In an eighth embodiment the present invention provides the tissue product of any one of the first through the seventh embodiments comprising from about 20 to about 50 weight percent high yield hesperaloe pulp fibers.

In a ninth embodiment the present invention provides the tissue product of any one of the first through the eighth embodiments wherein the tissue product is substantially free from softwood kraft pulp fibers.

In a tenth embodiment the present invention provides the tissue product of any one of the first through the ninth embodiments wherein the tissue product is substantially free from NSWK fibers.

In an eleventh embodiment the present invention provides a tissue product comprising at least one multi-layered through-air dried tissue web comprising a first and a second layer, the first layer being substantially free from high yield hesperaloe pulp fibers and the second layer consisting essentially of high yield hesperaloe pulp fibers, the tissue product having a GMT greater than about 1,000 g/3", a Durability Index greater than about 38 and a slough less than about 8.0 mg.

In a twelfth embodiment the present invention provides the tissue product of the eleventh embodiment having a dry burst strength greater than about 800 gf and a GM TEA greater than about 9.0 g·cm/cm$^2$.

In a thirteenth embodiment the present invention provides the tissue product of the eleventh or twelfth embodiments wherein the product comprises two or more tissue webs plied together in facing arrangement.

In a fourteenth embodiment the present invention provides the tissue product of any one of the eleventh through the thirteenth embodiments having a CD TEA greater than about 5.0 g·cm/cm$^2$.

In a fifteenth embodiment the present invention provides the tissue product of any one of the eleventh through the fourteenth embodiments wherein the slough less than about 8.0 mg and more preferably less than about 6.0 mg.

In a sixteenth embodiment the present invention provides a method of forming a resilient high bulk tissue product comprising the steps of: (a) dispersing high yield hesperaloe fiber in water to form a first fiber slurry; (b) dispersing conventional wood pulp fibers in water to form a second fiber slurry; (c) depositing the first and the second fiber slurries in a layered arrangement on a moving belt to form a tissue web; (d) non-compressively drying the tissue web to yield a dried tissue web having a consistency from about 80 to about 99 percent solids; and (e) calendering the dried tissue web to yield a finished tissue product.

In a seventeenth embodiment the present invention provides the method of the sixteenth embodiment wherein the resulting tissue product has a basis weight from about 20 to about 60 gsm, a sheet bulk greater than about 12 cc/g or greater and a slough less than about 6.0 mg.

In an eighteenth embodiment the present invention provides the method of the sixteenth or seventeenth embodiments wherein the tissue product comprises from about 5 to about 50 percent high yield hesperaloe fiber and less than about 10 percent, by weight of the tissue product, NSWK.

In a nineteenth embodiment the present invention provides the method of any one of the sixteenth through eighteenth embodiments wherein the step of calendering comprises passing the web through a nip having a load of at least about 40 pli, wherein the step of calendering reduces the sheet bulk by less than about 50 percent.

In a twentieth embodiment the present invention provides the method of any one of the sixteenth through nineteenth embodiments wherein the dried tissue web has a sheet bulk greater than about 15 cc/g and the finished tissue product has a sheet bulk greater than about 12 cc/g.

In a twenty-first embodiment the present invention provides a single-ply through-air dried tissue product comprising at least about 5 percent, by weight of the product, high yield hesperaloe pulp fibers, the tissue product having a GMT greater than about 1,000 g/3", a Stiffness Index less than about 7.0 and a slough less than about 8.0 mg.

In a twenty-second embodiment the present invention provides the tissue product of the twenty-first embodiment having a GM Slope less than about 6.0 kg.

In a twenty-third embodiment the present invention provides the tissue product of the twenty-first or the twenty-second embodiment having a slough less than about 6.0 mg.

In a twenty-fourth embodiment the present invention provides the tissue product of any one of the twenty-first through twenty-third embodiments having a dry burst strength greater than about 800 gf.

In a twenty-fifth embodiment the present invention provides the tissue product of any one of the twenty-first through twenty-fourth embodiments having a CD TEA greater than about 5.0 g·cm/cm2.

In a twenty-fifth embodiment the present invention provides the tissue product of any one of the twenty-first through twenty-fifth embodiments having a CD tensile strength greater than about 500 g/3".

What is claimed is:

1. A tissue product comprising at least one multi-layered through-air dried tissue web, the tissue web comprising a first and a second layer, the second layer comprising high yield hesperaloe pulp fibers and the first layer being substantially free from high yield hesperaloe pulp fibers, the tissue product comprising from about 5 to about 50 percent, by weight of the product, high yield hesperaloe fibers and having a geometric mean tensile (GMT) from 1,000 to 1,500 g/3" and a cross-machine tensile energy absorption (CD TEA) from about 6.0 to about 8.0 g·cm/cm$^2$.

2. The tissue product of claim 1 wherein the tissue product has a geometric mean tensile energy absorption (GM TEA) greater than about 9.0 g·cm/cm$^2$.

3. The tissue product of claim 2 having a TEA Index from 10.0 to 14.0.

4. The tissue product of claim 1 wherein the tissue product has a Stiffness Index from 4.0 to 8.0.

5. The tissue product of claim 1 having a cross-machine direction stretch (CD Stretch) from 10.0 to 14.0 percent.

6. The tissue product of claim 1 having a Tensile Ratio from 1.5 to 2.5.

7. The tissue product of claim 1 having a geometric mean slope (GM Slope) of less than about 6.0 kg.

8. The tissue product of claim 1 having a basis weight from about 30 to about 60 grams per square meter (gsm).

9. The tissue product of claim 8 having a sheet bulk greater than about 10 cc/g.

10. The tissue product of claim 1 having a dry burst strength of about 800 gf or greater.

11. The tissue product of claim 1 having a geometric mean tear (GM Tear) of about 15.0 gf or greater.

12. The tissue product of claim 1 having a Burst Index from 8.0 to 12.0 and a TEA Index from 10.0 to 14.0.

13. The tissue product of claim 1 wherein the at least one multi-layered through-air dried tissue web is substantially free from softwood kraft pulp fibers.

* * * * *